US005208208A

United States Patent [19]

Motoda et al.

[11] Patent Number: 5,208,208

[45] Date of Patent: May 4, 1993

[54] HEAT-SENSITIVE RECORDING MATERIAL

[75] Inventors: Makoto Motoda; Hideaki Senoo, both of Tokyo, Japan

[73] Assignee: Mitsubishi Paper Mills Limited, Tokyo, Japan

[21] Appl. No.: 733,830

[22] Filed: Jul. 22, 1991

[30] Foreign Application Priority Data

Jul. 25, 1990 [JP] Japan ..... 2-196818
Sep. 21, 1990 [JP] Japan ..... 2-253383

[51] Int. Cl.[5] ..... B41M 5/30

[52] U.S. Cl. ..... 503/208; 503/209; 503/214; 503/217; 503/225

[58] Field of Search ..... 503/208, 209, 214, 217, 503/225

[56] References Cited

U.S. PATENT DOCUMENTS

| | | | |
|---|---|---|---|
| 4,521,793 | 6/1985 | Kabashima et al. | 503/214 |
| 4,824,824 | 4/1989 | Matsushita et al. | 503/217 |
| 4,880,767 | 11/1989 | Hiraishi et al. | 503/217 |
| 4,965,237 | 10/1990 | Hiraishi et al. | 503/208 |
| 5,043,312 | 8/1991 | Hiraishi et al. | 503/208 |

FOREIGN PATENT DOCUMENTS

| | | |
|---|---|---|
| 4033657 | 7/1991 | Fed. Rep. of Germany . |
| 61-9463 | 1/1986 | Japan . |

*Primary Examiner*—Pamela R. Schwartz
*Attorney, Agent, or Firm*—Cushman, Darby & Cushman

[57] ABSTRACT

There is disclosed a heat-sensitive recording material comprising a support and a heat-sensitive recording layer formed on said support; said heat-sensitive recording layer containing an aromatic isocyanate compound and an imino compound as color developing agent and a silane-modified acrylic resin constituting at least a part of binder.

2 Claims, No Drawings

HEAT-SENSITIVE RECORDING MATERIAL

BACKGROUND OF THE INVENTION

1. Field of the Invention

This invention relates a heat-sensitive recording material with excellent printability and image storability.

2. Related Art

Recently, heat-sensitive recording materials capable of recording by use of thermal energy have come to be used in a variety of recording and printing devices such as printers or recorders for various types of measuring apparatus, labelling printers, POS printers and automatic vending machines for tickets or such.

The conventional heat-sensitive recording materials using an electron donative colorless dye precursor and an electron accepting color developer, while having various advantageous properties such as good appearance, good touch, high developed color density and various kinds of developed color hue, also had the defect that the image storability was poor; the recorded image portion (heat-sensitive color-forming portion) could disappear by the action of a plasticizer or additive(s) contained in a plastic such as polyvinyl chloride when contacted with the plastic, or were apt to disappear upon contact with chemicals contained in foods or cosmetics or to discolor on exposure to sunlight for a short period of time.

Various attempts have been made for overcoming said prior art problem of poor image storability. For example, U.S. Pat. Nos. 4,521,793, 4,824,824 and 4,880,767 disclose two-component thermal recording materials which are capable of forming a recorded image with good storability as a result of thermal reaction of the two components: an isocyanate compound and an imino compound.

However, these thermal recording materials comprising an imino compound and an isocyanate compound, although excellent in recorded image storability, has the defect that the heat-sensitive recording layer is partially picked off when functional side of the materials is printed (hereinafter referred to as "picking off"). Therefore, said thermal recording materials were unsuited for application to the printing or recording systems where printing has to be conducted on the recording layer, such as CD/ATM or handly terminals where the printouts of thermal recording material are used as a receipt or a notice. Thus, the improvement on this type of recording material has been keenly desired in the art.

In view of the above, the present invention is aimed at developing an image recording material having excellent printability and image storability.

SUMMARY OF THE INVENTION

In the course of studies for obtaining a heat-sensitive recording material having excellent printability and image storability, the present inventors found that the objective heat-sensitive recording material could be obtained by using a silane-modified acrylic resin as a part of the composition comprising principally an aromatic isocyanate compound and an imino compound. The present invention was achieved on the basis of this finding.

DETAILED DESCRIPTION OF PREFERRED EMBODIMENTS

The silane-modified acrylic resin used in the present invention can be obtained by various methods. A preferred method comprises emulsion polymerization, in an aqueous medium, of a monomer mixture consisting of an organosilicone monomer having a polymeric unsaturated group and a hydrolyzable group directly bonded to a silicon atom in the molecule and an acrylic or methacrylic ester, as for instance described in Japanese Patent Application Kokai (Laid-Open) No. 61-9463.

Among the acrylic or methacrylic esters usable in said monomer mixture, an alkyl ester is preferred, especially one in which the alkyl group has 1 to 18 carbon atoms. Among the silane-modified acrylic resins usable in the composition of this invention, it is preferred to use one of which glass transition temperature (Tg) is not higher than 15° C. in view of its anti-stick quality improving effect.

The silane-modified acrylic resin can be used in the form of an emulsion. It is also possible where necessary to use a silane compound jointly with said silane-modified acrylic resin.

Examples of the organosilicone monomers usable in said monomer mixture are vinyltrimethoxysilane, vinyltriethoxysilane, vinyltributoxysilane, vinyltris (β-methoxyethoxy)silane, allyltriethoxysilane, trimethoxysilylpropylallylamine, γ-acryloxypropyltrimethoxysilane, γ-methacryloxypropyltrimethoxysilane, γ-acryloxypropyltriethoxysilane, γ-methacryloxypropyltriethoxysilane, γ-acryloxypropylmethyldimethoxysilane, γ-methacryloxypropylmethyldimethoxysilane, γ-acryloxypropylmethyldiethoxysilane, γ-methacryloxypropylmethyldiethoxysilane, γ-acryloxypropyltris(γ-methoxyethoxy)silane, γ-methacryloxypropyltris(β-methoxyethoxy)silane, N-β-(N-vinylbenzylamino)ethyl-γ-aminopropyltrimethoxysilane, N-vinylbenzyl-γ-aminopropyltriethoxysilane, 2-styrylethyltrimethoxysilane, 3-(N-styrylmethyl-2-aminoethylamino)propyltrimethoxysilane, acryloxyethyldimethyl(3-trimethoxysilylpropyl)ammonium chloride, methacryloxyethyldimethyl(3-trimethoxysilylpropyl)ammonium chloride, vinyltriacetoxysilane and vinyltrichlorosilane. These silicone monomers may be used either singly or in combination.

Examples of said acrylic or methacrylic esters are methyl, ethyl, propyl, isopropyl, butyl, isobutyl, octyl, 2-ethylhexyl, lauryl, stearyl and cyclohexyl esters of acrylic or methacrylic acid. These acrylic or methacrylic esters may be used either singly or in combination.

Examples of the silane compounds usable optionally with said silane-modified acrylic resin include, beside the above-mentioned compounds usable as said organosilicone monomer, aminoalkylalkoxysilanes such as aminomethyltriethoxysilane, N-β-aminoethylaminomethyltrimethoxysilane, γ-aminopropyltrimethoxysilane, N-(trimethoxysilylpropyl)ethylenediamine and N-(dimethoxymethylsilylpropyl)ethylenediamine; epoxyalkylalkoxysilanes such as γ-glycidoxypropyltrimethoxysilane, γ-glycidoxypropylmethyldimethoxysilane, β-(3,4-epoxycyclohexyl)ethyltrimethoxysilane and β-(3,4epoxycyclohexyl)ethylmethyldimethoxysilane; mercaptoalkylalkoxysilanes such as γ-mercaptopropyltrimethoxysilane and γ-mercaptopropylmethyldimethoxysilane; tetraalkoxysilanes such as tetramethoxysilane, tetraethoxysilane, tetrapropoxysilane and tetrabutoxysilane; alkyltrialkoxysilanes such as methyltrimethoxysilane, methyltriethoxysilane, methyltrimethoxyethoxysilane and ethyltrimethoxysilane; dialkyldialkoxysilanes such as dimethyldimethoxysilane and dimethyldiethoxysilane; halogenated alkylalkoxysilanes such as γ-chloropropyltrimethoxysilane and 3,3,3-trichloropropyltrimethoxysilane; alkylacryloxysilanes such as methyltriacetoxysilane and dimethyldiacetoxysilane; and hydrosilane compounds such as trimethoxysilane and triethoxysilane.

In the composition of this invention, a silane-modified acrylic resin is contained in an amount of 1 to 40% by weight, preferably 4 to 18% by weight, more preferably 6 to 15% by weight, based on the total solids (exclusive of binder) of the heat-sensitive recording layer. When the content of said acrylic resin exceeds 40% by weight, there results an excessive reduction of developed color density. Said content is preferably kept below 18% by weight, more preferably below 15% by weight for maintaining the developed color density.

From the viewpoint of providing good adhesion while preventing picking off, the content of said silane-modified acrylic resin should be at least 1% by weight, preferably at least 4% by weight, 6% by weight being considered the best. Thus, by defining said content within the range of 4 to 18% by weight, especially 6 to 15% by weight, it is possible to obtain an excellent effect of preventing picking off while maintaining satisfactory developed color density. With the heat-sensitive recording material according to this invention, it is also possible to improve moisture resistance of the material in both background and the image portions. Moisture resistance can be a critical quality criterion in certain uses.

In the present invention, a known type of binder such as polyvinyl alcohol, methyl cellulose, polyacrylamide, starch or derivatives thereof, polyvinylpyrrolidone and the like can be used in combination with a silane-modified acrylic resin. Also, it is possible to further improve moisture resistance by adding aqueous colloidal silica (such as available from Nissan Chemical Co., Ltd.) which is an aqueous dispersion of a silicic acid condensation product.

The aromatic isocyanate compound used as a principal component of the heat-sensitive recording material of this invention is a colorless or light-colored aromatic isocyanate compound or heterocyclic isocyanate compound which is solid at normal temperature. Listed below are examples of the aromatic isocyanate compounds usable for said purpose of this invention:

2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenylether-4,4'-diisocyanate, naphthalin-1,4-diisocyanate, naphthalin-1,5-diisocyanate, naphthaline-2,6-diisocyanate, naphthalin-2,7-diisocyanate, 3,3'-dimethyl-biphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyante, fluorine-2,7-diisocyante, anthraquinone-2,6-diisocyanate, 9-ethylcarbazole-3,6-diisocyanate, pyrene-3,8-diisocyanage, naphthalin-1,3,7-triisocyanate, biphenyl-2,4,4'-triisocyanate, 4,4',4''-triisocyanate-2,5-dimethoxytriphenylamine, p-dimethylaminophenyl isocyanate and tris(4-phenyl isocyanate) thiophosphate, which may be used either singly or in combination.

These isocyanate compounds may be used in the form of so-called block isocyanates which are adducts with phenols, lactams, oximes or the like, or in the form of isocyanaurates which are dimers or trimers of diisocyanates such as 1-methylbenzene-2,4-diisocyanate. They may be also used as polyisocyanates adducted with various polyols.

The imino compound used as another principal component of the heat-sensitive recording material according to this invention is a compound represented by the formula:

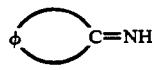

wherein $\phi$ is an aromatic compound residue which can form a conjugated system with an adjacent C=N. It is a colorless or light-colored compound which is solid at normal temperature. Examples of the imino compound are listed below:

3-iminoisoindoline-1-one, 3-amino-3,4,6,7-tetrachloroindoline-1-one, 3-imino-4,5,6,7-tetrabromoisoindiline-1-one, 3-imino-4,5,6,7-tetrafluoroindoline-1-one, 3-imino-5,6-dichloroisoindoline-1-one, 3-imino-4,5,7-trichloro-6-methoxy-isoindoline-1-one, 3-imino-4,5, 7-trichloro-6-methoxy-indoline-1-one, 3-imino-4,5,7-trichloro-6-methylmercapto-indoline-1-one, 3-imino-6-nitroisoindoline-1-one, 3-imino-isoindoline-1-spirodioxolane, 1,1-dimethoxy-3-imino-isoindoline, 1,1-diethoxy-3-imino-4,5,6,7-tetrachloroisoindoline, 1-ethoxy-3-imino-isoindiline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo(3,4b)pyrazine, 7-amino-2,3-diphenyl-5-oxopyrrolo(3,4b) pyrazine, 1-iminophthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichloroebenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-imonoisoindoline, 1-(N-ethylcarbazolyl-3'-imino)-3-iminoisoindoline, 1-(naphthaoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-6'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyradiisoindoline, 1-(cyanobenzoylmethylene)-3-iminoisoindoline, 1-(cyanocarbonamidemethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-(cyano-N-(3'-methylphenyl)carbamoylmethylene)-3-iminoisoindoline, 1-(cyano-N-(4'-chlorophenyl)carbamoylmethylene)-3-iminoisoindoline, 1-(cyano-N-(4'-methoxyphenyl)-carbamoylmethylene)-3-iminoisoindoline, 1-(cyano-N-(3'-chloro-4'-methylphenyl)carbamoylmethylene)-3iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2')-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-((cyanobenzimidazolyl-2')-methylene)-3-iminoisoindoline, 1-((cyanobenzimidazolyl-2')-methylene)-3-imino-4,5,6,7-tetrachloroisoindoline, 1-((cyanobenzimidazolyl-2')-methylene)-3-imino-5-methoxyisoindoline, 1-(cyanobenzimidazolyl-2')-methylene)-3-imino-6-chloroisoindoline, 1-((1'-phenyl-3'-methyl-5-oxo)-pyrazolidene-4')-3-iminoisoindoline, 1-((cyanobenzimidazolyl-2')-methylene)-3-imino-4,7-dithiatetrahydroisoindoline, 1-((cyanobenzimidazolyl-2')-methylene)-3-imino-5,6-dimethyl-4,7-pyradiisoindoline, 1-((1'-methyl-3'-n-butyl)-barbituric acid-5')-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindoline-1-one.

As the support for the heat-sensitive recording material according to this invention, paper is most conveniently used, but it is also possible to use various types of nonwoven fabrics, synthetic resin films, laminates, synthetic papers, metal foils or composite sheets thereof in conformity to the purpose of use.

The heat-sensitive recording layer may comprise a single layer structure. If necessary, there may be provided a protective layer on the heat-sensitive recording layer or an intermediate layer between the heat-sensitive recording layer and the support. In this case, the protective layer and/or the intermediate layer may be composed of two or more laminations. Also, on the side of the support opposite from the side formed with the heat-sensitive recording layer, there may be provided a back coat for preventing curling and static charging.

The heat-sensitive recording layer can be obtained by coating the surface of a support with a mixture of an aqueous dispersion prepared by grinding and dispersing the color forming components, a binder of this invention and other additives, and drying the coated layer. Said heat-sensitive recording layer may have a multilayer structure in which each color forming component is contained in one layer.

The heat-sensitive recording material according to this invention may further contain a heat-fusible compound for improving thermal response. As the heat-fusible compound, it is preferred to use one having a melting point of 60° to 180° C., preferably 80° to 140° C. Preferred examples of such heat-fusible compound are benzyl p-benzyloxybenzoate, stearic acid amide, palmitic acid amide, N-methylolstearic acid amide, β-naphthylbenzyl ether, N-stearylurea, N,N'-distearylurea, phenyl β-naphthoate, phenyl 1-hydroxy-2-naphthoate, β-naphtol(p-methylbenzyl)ether, 1,4-dimethoxynaphthalene, 1-methoxy-4-benzyloxynaphthalene, N-stearoylurea, 4-benzylbiphenyl, 1,2-di(m-methylphenoxy)ethane, 1-phenoxy-2-(4-chlorophenoxy)ethane, 1,4-butanediolphenyl ether, dimethyl terephthalate and the like. These heat-fusible compounds may be used either singly or in combination. For obtaining sufficient thermal responsiveness, it is recommended that said heat-fusible compound(s) be used in an amount of 10 to 300% by weight, preferably 20 to 250% by weight, based on the aromatic isocyanate compound.

Further, in the heat-sensitive recording material of this invention, there may be contained an aniline derivative having at least one amino group, such as disclosed in U.S. Pat. No. 4,965,237 (International Application W087/06885) filed by the present applicant, for preventing background fogging.

Examples of the compounds usable for said purpose are methyl p-aminobenzoate, ethyl p-aminobenzoate, p-aminobenzoic acid-n-propyl, p-aminobenzoic acid-iso-propyl, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-(N-(4-chlorophenyl)-carbamoyl)aniline, p-(N-(4-aminophenyl)carbamoyl)aniline, 2-methoxy-5-(N-phenylcarbamoyl)aniline, 2-methoxy-5-(N-(2'-methyl-3'-chlorophenyl)carbamoyl)aniline, 2-methoxy-5-(N-(2'-chlorophenyl)carbamoyl)aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-diethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis(4-(m-aminophenoxy)-phenyl)sulfone, bis(4-(p-aminophenoxy)phenyl)sulfone, bis(3-methyl-4-(p-aminophenoxy)phenyl)sulfone, 3,3'-dimethoxy-4,4'-diaminobiphenyl, 3,3'-dimethyl-4,4'-diaminobiphenyl, 2,2'-dichloro-4,4'-diamino-5,5'dimethoxybiphenyl, 2,2',5,5'-tetrachloro-4,4'- diaminobiphenyl, ortho-tolidinesulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 2,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)sulfone, bis(4-aminophenyl)sulfone, bis(3aminophenyl)sulfone, 3,4'-diaminodiphenylsulfone, 3,3'diaminodiphenylmethane, 4,4'-ethylenedianiline, 4,4'-diamino-2,2'-dimethyldibenzyl, 4,4'-diamino-3,3'dichlorodiphenylmethane, 3,3'-diaminobenzophenone, 4,4-diaminobenzophenone, 1,4-bis(4-aminophenoxy)benzene, 1,3-bis(4-aminophenoxy)benzene, 1,3-bis(3-aminophenoxy)benzene, 9,9-bis(4-aminophenyl)fluorene, 2,2-bis(4-aminophenoxyphenyl)propane, 4,4'-bis(4-aminophenoxy)-diphenyl, 3,3',4,4'-tetraaminodiphenyl ether, 3,3',4,4'-tetraaminodiphenyl ether, and 3,3',4,4'-tetraaminobenzophenone.

The heat-sensitive recording layer may also contain a pigment such as diatomaceous earth, talc, kaolin, calcined kaolin, calcium carbonate, magnesium carbonate, titanium oxide, zinc oxide, silicon oxide, aluminum hydroxide, urea-formaldehyde resin and the like. It may further contain, for the purpose of preventing wear of thermal head and sticking, a higher aliphatic acid metal salt such as zinc stearate and calcium stearate, a wax such as paraffin, paraffin oxide, polyethylene, polyethylene oxide, stearic acid amide and castor wax, and a dispersent such as sodium dioctylsulfosuccinate. Other additives such as an ultraviolet absorber, for example, that of benzophenone, benzotriazole or other system, a surface active agent, a fluorescent dye, etc., may also be contained as desired.

The present invention is characterized in that a silane-modified acrylic resin is contained in the heat-sensitive recording material. This silane-modified acrylic resin does not harmfully affect the color forming reaction under heating of an aromatic isocyanate compound and an imino compound. Therefore, by using said silane-modified acrylic resin as binder of the heat-sensitive recording layer, it is possible to provide a favorable printable characteristics to the heat-sensitive recording material comprising an aromatic isocyanate compound and an imino compound and having excellent image storability.

EXAMPLES

The present invention will be described more particularly with reference to the examples thereof, which examples, however, are merely intended to be illustrative and not to be construed as limiting the scope of the invention.

The practical effect of the heat-sensitive recording material according to this invention was evaluated by the following test methods.

Test 1 (Printability Test)

Printability was evaluated by RI printability test. Printing was conducted using an RI printing tester using a paper testing ink (New Poas G Indigo available from Dai-Nippon Ink Chemical Industries Co., Ltd.), and unevenness of the resulting print density caused by picking off was visually judged.

The visual evaluation on picking off was made according to the following criteria:

◎ : The print was substantially free of unevenness due to picking off.

○ : The print showed a slight degree of unevenness due to picking off, which however presented no problem in practical use.

Δ : The print showed a considerable unevenness due to picking off, posing a problem in practical use.

X : Picking off is prevailing, indicating impossibility for practical use.

Test 2 (Density of color developed)

The heat-sensitive recording materials obtained in Examples 1 to 8 and Comparative Examples 1 to 3 were fed to a thermal facsimile printing tester under the conditions of applied pulse duration = 1.1 msec and applied voltage = 22.00 V; the density of the color developed thereunder was measured by a densitometer MacBeth RD 918.

Test 3 (Moisture resistance test)

The background (non-color-developed portion) or the image portion (color-developed portion) of each of the heat-sensitive recording materials obtained in Examples 1–8 and Comparative Examples 1–3 was placed and fixed on a balance with the heat-sensitive recording layer positioned on the upside. Then a few drops of water were put the heat-sensitive recording layer and the silicone rubber plug (2 cm in diameter) set at the end of a motor was pressed against the wet portion of the layer to apply a load of 600 g (pressure: 191 g/cm$^2$). Thereafter, the motor was run for 5 seconds at a speed of 300 r.p.m., and occurence or non-occurrence of separation (peeling) of the heat-sensitive recording layer, and the degree of separation when it occurred, were visually observed.

Visual judgement of separation of the heat-sensitive recording layer was made according to the following criteria:

○ : The heat-sensitive recording layer showed no change at all and had very excellent moisture resistance.

Δ : Said layer suffered partial separation but had good moisture resistance.

X : Said layer peeled entirely, indicating poor moisture resistance of the layer.

EXAMPLE 1

15 g of 1,3-diimino-4,5,6,7-tetrachloroisoindoline was ground by a ball mill with 60 g of a 1% polyvinyl alcohol solution for 25 hours to prepare a dispersion. Separately, 10 g of 4,4',4''-triisocyanate-2,5-dimethoxytriphenylamine was ground by a ball mill with 40 g of a 1% polyvinyl alcohol solution for 24 hours to obtain a dispersion. Also, 0.4 g of 2-methoxy-5-N,N-diethylsulfamoylaniline was similarly ground with 20 g of a 1% polyvinyl alcohol, while 21 g of 4-hydroxyemthylbiphenyl and 4 g of metaterphenyl were likewise ground with 125 g of a 1% polyvinyl alcohol solution, thereby preparing the respective dispersions. The thus prepared four dispersions were mixed, and 125 g of a 40% solid aqueous dispersion of calcium carbonate and 50 g of a 30% solid aqueous dispersion of zinc stearate were added, followed by further addition of 37 g of a silane-modified acrylic resin with Tg of −13° C. (Acryset 181E produced by Nippon Shokubai Co., Ltd.; solids concentration: 28%) and 90 g of water and sufficient stirring of the mixture to prepare a coating liquor. This coating liquor in turn was coated on a base paper having a basis weight of 50 g/m$^2$ to a coating weight (as solid) of 5.2 g/m$^2$. After drying the coated layer, the coated paper was supercalendered to obtain a heat-sensitive recording material.

In the above product, the content of the silane-modified acrylic resin based on the total solids exclusive of binder in the heat-sensitive recording layer was 9% by weight.

EXAMPLE 2

A heat-sensitive recording material was obtained by following the same process as Example 1 except that a silane-modified acrylic resin with Tg of 15° C. (Acryset A-0524 produced by Nippon Shokubai Co., Ltd.; solids concentration: 27%) was used in place of Acryset 181E.

COMPARATIVE EXAMPLES 1-3

Heat-sensitive recording materials were obtained by following the same process as Example 1 except for use of the binders specified below in place of the silane-modified acrylic resin Acryset 181E. In these products, the content of the specified binders based on the total solids exclusive of binder in the heat-sensitive recording layer was 10% by weight.

Specific binders used here:

A polyvinyl alcohol (PVA) solution (NM-11 produced by Nippon Gosei Kagaku Co., Ltd.) . . . Comparative Example 1.

A silane-modified PVA (R-2105 produced by Kuraray Co., Ltd.) . . . Comparative Example 2.

A silane-modified PVA (R-1130 produced by Kuraray Co., Ltd.) . . . Comparative Example 3.

EXAMPLES 3-13

Heat-sensitive recording materials were obtained by following the same procedure as Example 1 except that the content of the silane-modified acrylic resin was changed to 6%, 7%, 8%, 9%, 10% and 11% by weight, and that PVA (NH-20 produced by Nippon Gosei Kagaku Co., Ltd.) was used as other binder in a fixed amount of 3% by weight.

The obtained heat-sensitive recording materials were hereinafter referred to as the products of Examples 3-8, respectively.

There were also obtained heat-sensitive recording materials by following the process of Example 1 except that the content of the silane-modified acrylic resin was changed to 2%, 4%, 15%, 20% and 40% by weight. The obtained recording materials are hereinafter referred to as the products of Examples 9-13, respectively.

COMPARATIVE EXAMPLE 4

A heat-sensitive recording material was obtained by repeating the process of Example 1 except that the silane-modified acrylic resin content was changed to 45% by weight.

The test results in Examples 1-13 and Comparative Examples 1-4 are shown in Table 1.

TABLE 1

| | Type of binder | Binder content (%) | Test 1 Evaluation of picking off | Test 2 Color density | Test 3 Moisture resistance |
|---|---|---|---|---|---|
| Example 1 | Silane-modified acrylic resin | 9 | ◎ | 1.03 | ○ |
| Example 2 | Silane-modified acrylic resin | 9 | ○ | 1.00 | ○ |
| Comp. Example 1 | PVA | 9 | X | 1.01 | X |
| Comp. Example 2 | Silane-modified PVA | 9 | Δ | 0.96 | X |
| Comp. Example 3 | Silane-modified PVA | 9 | Δ | 0.98 | X |
| Example 3 | Silane-modified acrylic resin and PVA | 6<br>3 | ○ | 1.05 | ○ |
| Example 4 | Silane-modified acrylic resin and PVA | 7<br>3 | ○ | 1.06 | ○ |
| Example 5 | Silane-modified acrylic resin and PVA | 8<br>3 | ○ | 1.04 | ○ |
| Example 6 | Silane-modified acrylic resin and PVA | 9<br>3 | ○ | 1.04 | ○ |
| Example 7 | Silane-modified acrylic resin and PVA | 10<br>3 | ◎ | 1.02 | ○ |
| Example 8 | Silane-modified acrylic resin and PVA | 11<br>3 | ◎ | 1.03 | ○ |
| Example 9 | Silane-modified acrylic resin | 2 | Δ | 1.02 | ○ |
| Example 10 | Silane-modified acrylic resin | 4 | ○ | 1.02 | ○ |
| Example 11 | Silane-modified acrylic resin | 15 | ◎ | 1.00 | ○ |
| Example 12 | Silane-modified acrylic resin | 20 | ○ | 0.98 | ○ |
| Example 13 | Silane modified acrylic resin | 40 | Δ | 0.90 | ○ |
| Comp. Example 4 | Silane modified acrylic resin | 45 | X | 0.85 | ○ |

EXAMPLES 14-16

Heat-sensitive recording materials were obtained by following the process of Example 1 except for use of the silane-modified acrylic resins with specified Tg's (0° C. in Example 14, 5° C. in Example 15 and 10° C. in Example 16) in place of the silane-modified acrylic resin used in Example 1.

COMPARATIVE EXAMPLE 5

A heat-sensitive recording material was obtained by following the process of Example 1 except for use of styrenebutadiene rubber (Tg: 6° C.) in place of the silane-modified acrylic resin used in Example 1.

COMPARATIVE EXAMPLE 6

A heat-sensitive recording material was obtained by following the process of Example 1 except for use of silane-modified acrylic resin having a Tg of 20° C. in place of the silane-modified acrylic resin used in Example 1.

The test results in Examples 14-16 and Comparative Examples 5 and 6 are shown in Table 2.

TABLE 2

| | Tg (°C.) | Test 1 Evaluation of picking off | Test 2 Developed color density | Test 3 Moisture resistance |
|---|---|---|---|---|
| Example 14 | 0 | ○ | 0.90 | ○ |
| Example 15 | 5 | ◎ | 0.90 | Δ |
| Example 16 | 10 | ○ | 0.87 | Δ |
| Comp. Example 5 | 6 | X | 0.82 | X |
| Comp. Example 6 | 20 | Δ | 0.81 | X |

As is apparent from Tables 1 and 2, the heat-sensitive recording material comprising an aromatic isocyanate compound and an imino compound is provided with excellent printability and good image storability by use of a silane-modified acrylic resin according to this invention as a binder in the composition.

What is claimed is:

1. A heat-sensitive recording material comprising a support and a heat-sensitive recording layer formed in said support; said heat-sensitive recording layer containing an aromatic isocyanate compound, an imino compound as color developing agent and a silane modified acrylic resin constituting at least 1 to 40% by weight based on the total solids exclusive of the binder in the heat-sensitive recording layer.

2. A heat-sensitive recording material according to claim 1, wherein said silane-modified acrylic resin has a glass transition temperature (Tg) of 15° C. or below.

* * * * *